US007730559B2

(12) United States Patent
Gallizia

(10) Patent No.: US 7,730,559 B2
(45) Date of Patent: Jun. 8, 2010

(54) TOILET SEAT FOR SEALED ENGAGEMENT WITH TOILET BOWL AND COMMUNICATION WITH AIR EXTRACTION SYSTEM

(76) Inventor: Alain-Dominique Gallizia, 39 Quater, rue de la Belle Feuille, 92100 Boulogne Billancourt (FR)

( * ) Notice: Subject to any disclaimer, the term of this patent is extended or adjusted under 35 U.S.C. 154(b) by 0 days.

(21) Appl. No.: 11/706,717

(22) Filed: Feb. 15, 2007

(65) Prior Publication Data

US 2007/0204385 A1 Sep. 6, 2007

(30) Foreign Application Priority Data

Feb. 16, 2006 (FR) ..... 06 01368

(51) Int. Cl.
*E03D 9/052* (2006.01)

(52) U.S. Cl. ..... 4/213; 4/242.1; 4/246.1

(58) Field of Classification Search ..... 4/217, 4/352, 242.1, 233–234, 213, 216, 348–351, 4/472, 475, 477, 482; D23/311
See application file for complete search history.

(56) References Cited

U.S. PATENT DOCUMENTS 759,473 A * 5/1904 Rosseau ..... 4/217
1,090,508 A * 3/1914 Wilcox ..... 4/234
1,207,605 A * 12/1916 Morton ..... 4/217
2,134,629 A * 10/1938 Walsh et al. ..... 4/213
2,238,461 A * 4/1941 Carman ..... 4/213
2,519,286 A * 8/1950 Riedele ..... 4/217
2,728,921 A * 1/1956 Dorko ..... 4/216
5,771,502 A * 6/1998 O'Grady ..... 4/405
5,930,844 A * 8/1999 Scott, III ..... 4/213
6,212,694 B1 * 4/2001 Porzio ..... 4/246.1
7,117,549 B1 * 10/2006 Hannigan ..... 4/233
2003/0019019 A1 * 1/2003 Blanch et al. ..... 4/213

* cited by examiner

*Primary Examiner*—Robert M Fetsuga
(74) *Attorney, Agent, or Firm*—Gerald E. Hespos

(57) ABSTRACT

A toilet seat is provided for mounting on a toilet bowl (1) and is configured to be placed in communication with a mechanical air extraction system. The toilet seat includes a seat (4) that can be applied in a sealed manner on the toilet bowl. The toilet seat (4) has an air inlet (6) at the front and an air outlet (7) at the rear. The outlet (7) is connected by ducts (8, 9, 10) to the air extraction system (14, 15). A cover (11) is hinged in proximity to the seat (4). The cover (11) is configured to prevent the toilet bowl (1) from being flushed when the cover (11) is in the open position and seals the front air inlet (6) when the cover is in the closed position.

9 Claims, 3 Drawing Sheets

TOILET SEAT FOR SEALED ENGAGEMENT WITH TOILET BOWL AND COMMUNICATION WITH AIR EXTRACTION SYSTEM

BACKGROUND OF THE INVENTION

1. The present invention relates to a seat for toilets with air circulation, directly inhaling the odours at the level of the bowl.

2. Description of the Related Art. In fact, in the majority of sanitary ware, the controlled mechanical ventilation system or CMV, situated in general at a height, even on the ceiling of the room, makes the odours from using toilet bowls reach the nose of occupants in an injudicious manner.

Numerous models of toilets with air circulation have already been proposed in the past with the aim of reducing or suppressing the odours which are given off. The extraction of air at the level of the bowl is effected, either by means of the CMV equipping the premises or by means of an electric motor which is specially assigned for this use.

However, none of these proposals is at present entirely satisfactory and, moreover, as far as we know there is no industrial production. Furthermore, in the case of the CMV, the extraction of the air is effected there generally in a permanent manner which can lead to disturbances in the general ventilation system of the room, the house or the communal block of flats.

The main object of the present invention is therefore to remedy this lack and, in order to do this, the subject thereof is a seat which is intended to be mounted over the majority of toilet bowls, the room of which is equipped with an air extraction system, characterised essentially in that it is composed of a seat which comes to be applied in a sealed manner on the bowl, whilst providing a front air inlet and a rear air outlet, said outlet being connected to the air extraction system, and a cover which, when in the closed position, seals the front air inlet.

SUMMARY OF THE INVENTION

In a particular embodiment of the invention, the seat is formed by a ring of a shape adapted to that of the bowl, and provided on its lower face with two lateral parts which rest in a sealed manner on the bowl, whilst the cover is arranged on the seat and the cover comprises a lower shoulder at the front which comes to mask the free space provided between the two lateral parts of the seat.

Hence, when using the toilet, raising the seat initiates a circulation of air through the bowl between the inlet and the outlet, which allows evacuation of the bad odours on a permanent basis. After use, and on the condition of having previously put down the cover, the bowl is practically sealed, thus avoiding the release of malodorous gases into the room during activation of the flush, under the effect of the massive arrival of a certain quantity of water in the bowl. Sealing the air intake at the level of the bowl thus avoids disturbing the high air aspiration of the CMV in the room which again becomes solely effective.

Preferably, the cover comprises a handle which is disposed in order to prevent activation of the flush when said cover is in the open position.

Hence the release of malodorous gases during activation of the flush is avoided. Furthermore, the presence of a handle makes handling of the cover more hygienic.

Also preferably, the fixed quantity via the front air inlet is less than the quantity of air extracted via the rear outlet, which makes it possible to keep the bowl at low pressure during the duration of use and even more so after closing the cover.

Several embodiments of the invention are described hereafter by way of examples, with reference to the annexed drawings.

DETAILED DESCRIPTION OF THE PREFERRED EMBODIMENTS

Figure 2:
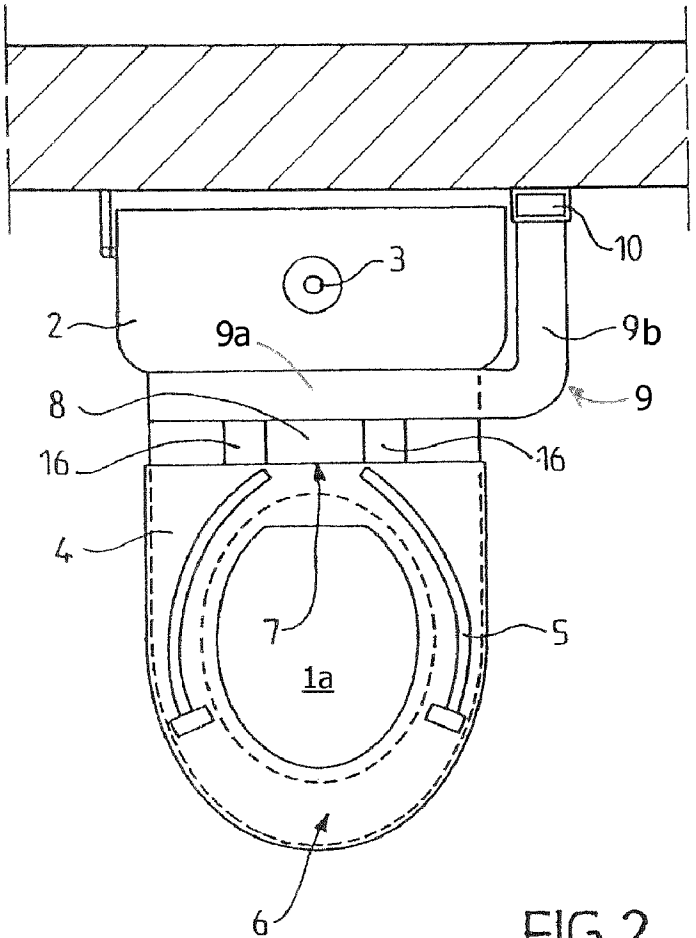
FIG. 2 is a view from above of the bowl with the cover of the seat removed.
Figure 1:
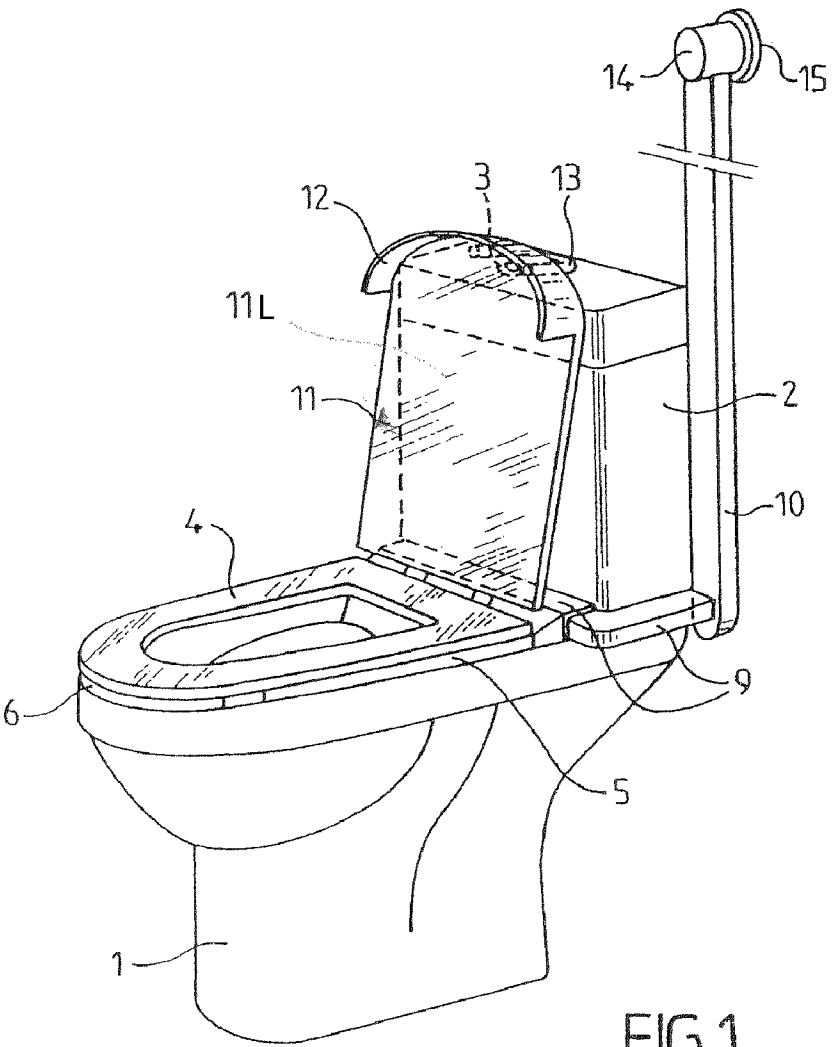
FIG. 1 is a perspective view of a toilet bowl equipped with a seat according to the invention.

The toilets represented in FIGS. 1 to 4 comprise firstly a bowl 1 which is surmounted by a water flush reservoir 2, provided with an activation button 3 on its upper part. The bowl 1 has a top 1T with an opening 1*a*. According to the invention, these toilets are equipped with a seat formed by a ring 4 having a curved front, the shape of which corresponds to the curved front of the bowl 1. The seat 4 is provided on its lower face with two lateral parts 5 which rest in a sealed manner on the upper edge of the bowl, providing a front air inlet 6 at the curved front of the bowl 1 and the seat 4 and a rear air outlet 7. More particularly, two lateral parts 5 rest in a sealed manner on the upper edge of the toilet bowl 1 at all lateral positions between the front air inlet 6 and the rear air outlet 7 as shown clearly in FIGS. 1, 2 and 4-8. This seat is fixed in a standard fashion on the bowl by means of two threaded rods associated with nuts 16 disposed at opposite respective sides of the rear air outlet 7.

The air outlet 7 is connected to the mechanical ventilation (CMV) equipping the premises, by means of an airbox 8 and by means of ducts such as 9 and 10. The airbox 8 is disposed between the seat 4 and the flush reservoir 2, and between the two threaded rods associated with nuts 16. The airbox 8 is continuous with the air outlet 7 in order to avoid any siphoning. The duct 9 has a first leg 9*a* on the top of the bowl 1 and extending laterally from the air box 8 in a position between the seat 4 and the flush reservoir 2. The duct 9 further has a second leg 9*b* that extends rearwardly adjacent a lateral side of flush reservoir 2. The vertical duct 10 is situated on the opposite side to that of the tap for supplying the reservoir and it is connected to the branch coupling 14 which is positioned on the general mechanical air vent 15. This secondary branch coupling will be of a diameter which is much less than that of the main mechanical ventilation of the room in order to avoid any reversal of the system which is prejudicial overall to the house or block of flats.

In the absence of CMV in the premises, an independent electric motor which is connected to an outlet which is specially provided for this purpose will be able to be provided. Furthermore, the air inlet 6 is calculated to ensure a quantity of air less than that of the air outlet 7 situated at the rear, in order to produce low pressure in the bowl 1.

The special straight rear shape of the seat serves also to reduce its opening at the rear and thus to limit air intakes too close to the outlet 7, which assist siphoning.

Figure 4:
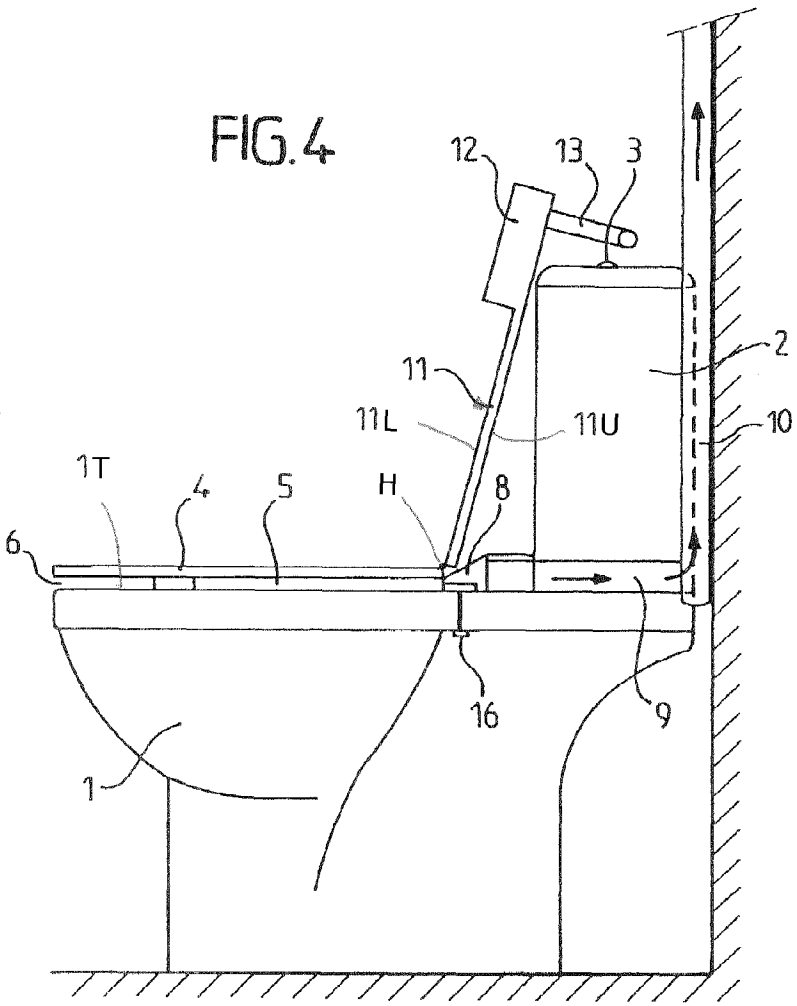
FIG. 4 is a side view with the cover open.

The seat according to the invention is completed by a cover 11 which is attached on the seat 4 at a location H in proximity to the rear air outlet 7 and the air box 8, as shown in FIG. 4.

Figure 3:
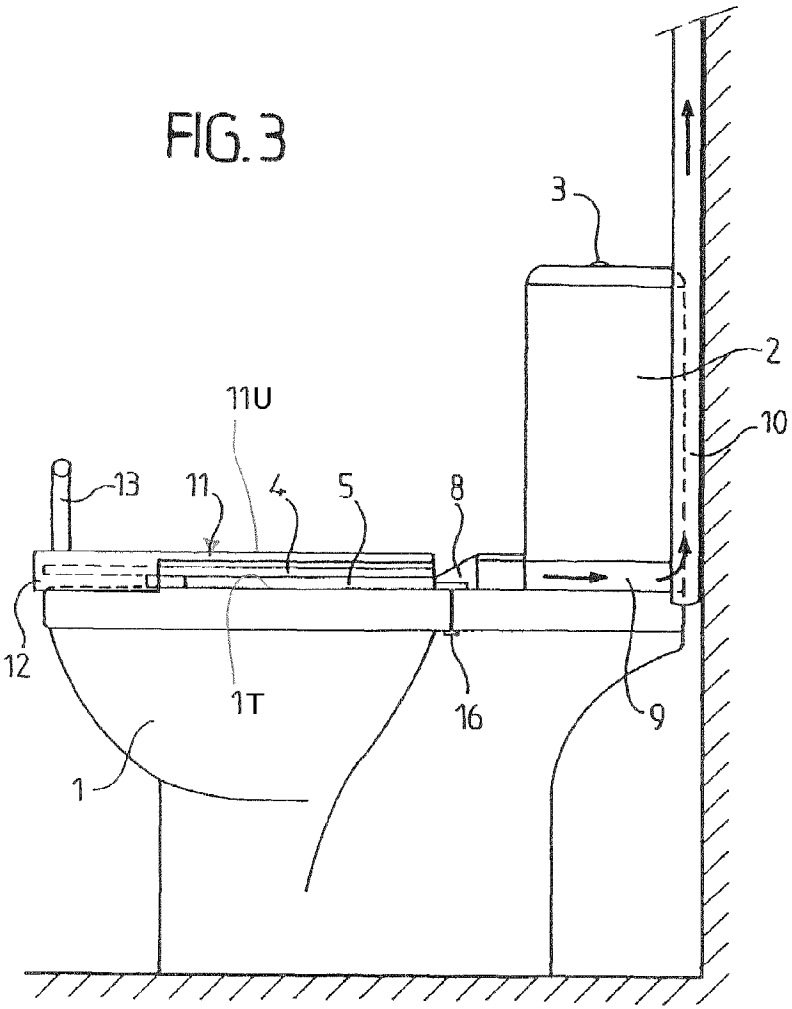
FIG. 3 is a side view with the cover closed.
Figure 5:
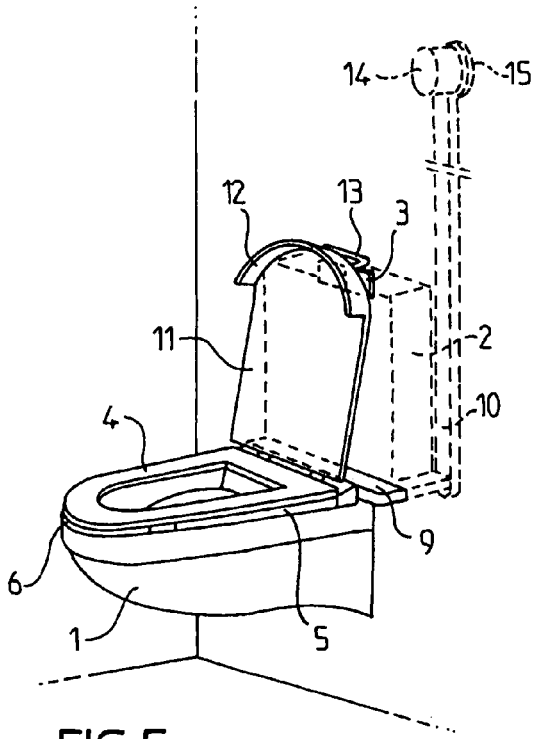
FIGS. 5 to 8 are views analogous to FIGS. 1 to 4 of an embodiment variant of the invention.
Figure 6:
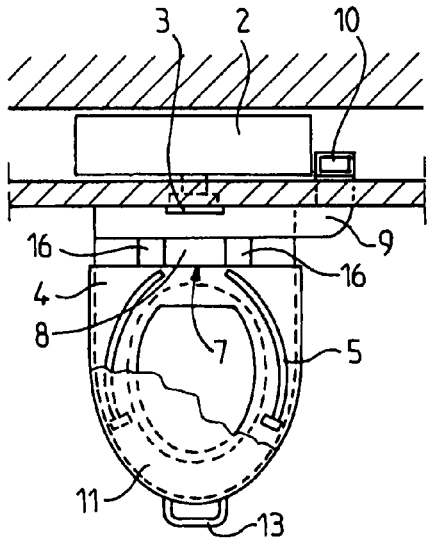
Figure 7:
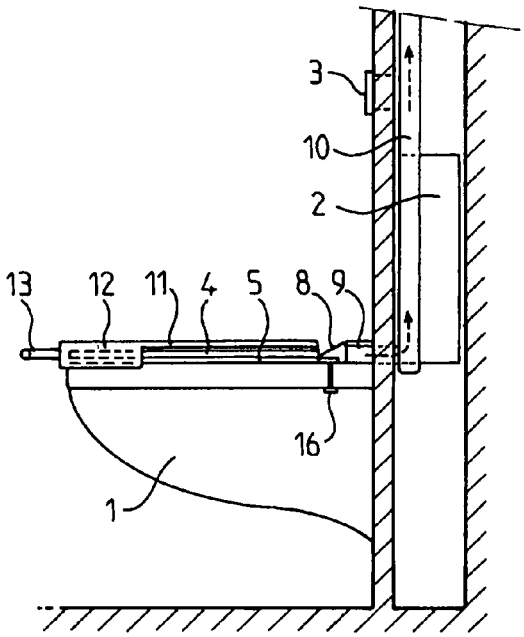
Figure 8:
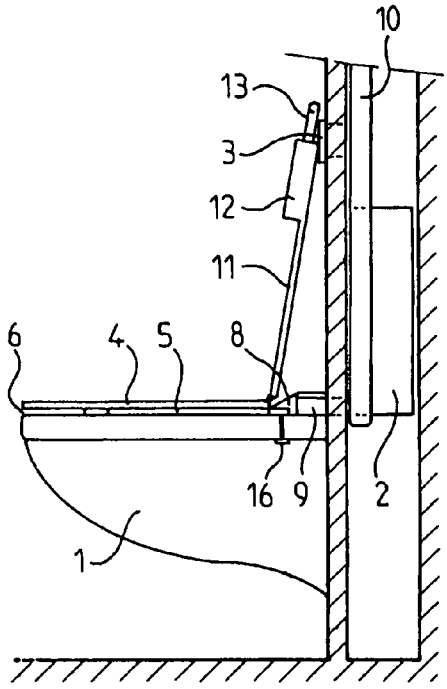

The cover 11 has opposite upper and lower faces 11U and 11L. The lower face 11L comprises at the front a lower shoulder 12 which defines a curved wall substantially corresponding to the curved fronts of the bowl 1 and the seat 4. The lower shoulder 12 projects sufficiently to extend below the top 1T of the bowl 1 and comes to seal the air inlet 6 when the cover is put down on the seat, as represented in FIG. 3. Preferably, this cover 11 is provided on its upper face 11U with a handle 13 that is substantially aligned with the lower shoulder 12 and which, when the cover is open as represented in FIG. 4, prevents access to the activation button 3 of the flush.

Hence, during use of the toilet, a circulation of air is naturally established between the inlet 6 and the outlet 7 under the effect of the low pressure caused by the CMV. The bad smells are therefore automatically and permanently evacuated towards the exterior at the level of the bowl by the CMV, without having to cross the room to be recovered at a height, as is the case to date.

After use, firstly the cover 11 should be put down on the seat 4 in order to gain access to the activation button 3 of the flush. This done, the air inlet 6 is sealed by the shoulder 12 of the cover 11, thus making the toilet practically sealed. Thanks to this disposition, during activation of the flush, the release of malodorous gases into the premises which are released from the bowl by the sudden arrival of a large quantity of water is avoided.

Once the cover is put down, the air inlet 6 is sealed by the shoulder 12 of the cover, thus making the toilet quasi-sealed.

It should be noted furthermore that out with periods of use of the toilet, and on the condition that the cover 11 is properly closed, the bowl 1 only aspirates air very slightly due to the lack of an air inlet, which makes it possible to make the high air intake of the CMV from the room entirely effective and to avoid any disturbance to the system of the house or the communal block of flats.

The embodiment variant represented in FIGS. 5 to 8 illustrates the application of the invention to a toilet system with integrated reservoir, i.e. in which the reservoir for the water flush 2 is incorporated in the wall so as to be invisible. Only the activation button 3 of the flush is visible through an opening provided for this purpose in the wall. In this case, the handle 13 is situated in an extension of the cover 11 at a position substantially aligned with the lower shoulder 12 and also serves to prevent access to the activation button 3, whilst playing a part in generally improving hygiene.

Of course, the invention is not limited to this embodiment example which is represented and described, and numerous modifications can be applied to it without moreover departing from the scope of the present invention.

The invention will be able in particular to be adapted without difficulty to the majority of existing toilets. It will be possible even to re-use existing toilets simply by adding two lateral shoes 5 in the form of adhesive beadings and by coupling an air intake thereto at the rear, connected to the existing CMV or to mechanical ventilation to be produced. Of course, it will also be suitable to modify the cover consequently by adding a shoulder 12 and a handle 13 thereto.

Toilets which are specially adapted to the invention can also be imagined. In this last case, the air intake will advantageously be able to be integrated in the porcelain of the bowl which it will pass over in order to come behind the reservoir, or at the side if it is integrated, to be connected to the vertical rear duct 10 which is itself hidden behind the linings of the room in order overall to make the system totally invisible.

What is claimed is:

1. A seat intended to be mounted on a toilet bowl (1) having a top and an opening into the top, characterised in that the seat comprises a toilet seat (4) adapted to be applied on the top of the bowl (1) by two laterally spaced threaded rods (16) for fixing the toilet seat (4) on the toilet bowl (1), the toilet seat (4) having a shape adapted to a shape of the bowl (1) while providing a front air inlet (6), a rear air outlet (7) aligned between the two laterally spaced threaded rods (16) and two lateral parts (5) on a lower face of the toilet seat (4) and extending between the front air inlet (6) and the rear air outlet (7), the lateral parts (5) being configured to rest in a sealed manner on the top of the toilet bowl (1) at all lateral positions between the front air inlet (6) and the rear air outlet (7), an air box (8) between the threaded rods (16) and communicating with said rear air outlet (7), a duct (9, 10) extending from the rear air outlet (7) and being adapted to be connected to an air extraction system (14, 15), and a cover (11) connected to the seat (4) at a location in proximity to the rear air outlet (7) and the air box (8), the cover (11) having a lower shoulder disposed and dimensioned to project to a position below the top of the toilet bowl (1) and to seal the front air inlet (6) between the toilet seat (4) and the toilet bowl (1) when the cover (11) is in a closed position so that the toilet bowl (1) is sealed sufficiently to avoid release of malodorous gases from the toilet bowl (1) when the cover (11) is in the closed position, the cover (11) further having a handle (13) disposed to prevent access to a flush activator (3) of the toilet bowl when said cover (11) is in an open position and when the lateral parts of the toilet seat rest in a sealed manner on the toilet bowl.

2. The seat according to claim 1, characterised in that the flow coming from the front air inlet (6) is less than the flow of air extracted via the rear outlet (7).

3. The seat according to claim 1, wherein the cover has opposite upper and lower surfaces, the lower shoulder (12) extending from the lower surface of the cover (11), the handle (13) extends from the upper surface of the cover and is substantially aligned with the lower shoulder (12).

4. A toilet comprising a toilet bowl (1) having a top and an opening extending into the top, a flush reservoir (2) on the top of the toilet bowl rearward of the opening, a toilet seat (4) secured adjacent the top of the bowl (1) by two laterally spaced threaded rods (16), the toilet seat (4) having a shape adapted to a shape of the bowl (1) while providing a front air inlet (6), a rear air outlet (7) aligned between the two laterally spaced threaded rods (16) and two lateral parts (5) on a lower face of the toilet seat (4), the lateral parts (5) being configured to rest in a sealed manner on the toilet bowl (1) at all lateral positions between the front air inlet (6) and the rear air outlet (7), an air box (8) between the threaded rods (16) and communicating with said rear air outlet (7), a duct (9) having a first leg (9*a*) between the air box (8) and the flush reservoir (2) and a second leg 9(*b*) adjacent a lateral side of the flush reservoir, the duct (9) being connected to an air extraction system (14, 15), and a cover (11) having a rear end connected to the seat (4) at position (H) in proximity to the rear air outlet (7) and the air box (8) and a front end with a lower shoulder (12) configured project to a position below the top of the toilet blow (1) and to seal the front air inlet (6) between the toilet seat (4) and the toilet bowl (1) when the cover (11) is in a closed position, so that the toilet bowl is sealed sufficiently to avoid release of malodorous gases from the toilet bowl (1) when the cover (11) is in the closed position, the cover (11) further having a handle (13) disposed to prevent activation of a flush activator (3) of the toilet when said cover (11) is in an open position and when the lateral parts of the toilet seat rest in a sealed manner on the toilet bowl.

5. The toilet according to claim 4, characterised in that the flow coming from the front air inlet (6) is less than the flow of air extracted via the rear outlet (7).

6. The toilet according to claim 4, wherein the cover has opposite upper and lower surfaces (11U, 11L), the lower shoulder (12) extending from the lower surface (11L) of the cover (11), the handle (13) extends from the upper surface (11U) of the cover (11) and is substantially aligned with the lower shoulder (12).

7. The toilet according to claim 4, wherein the toilet bowl (1) and the toilet seat (4) each having a curved front, the front air inlet (6) extending along parts of the curved fronts of the toilet bowl (1) and the toilet seat (4), the lower shoulder (12) being a curved wall extending sufficiently along the curved fronts of the toilet bowl (1) and the toilet seat (4) to seal the front air inlet (6) when the cover (11) is in the closed position.

8. The toilet according to claim 4, wherein the lower shoulder (12) partly overlaps with the two lateral parts (5) when the cover is in the closed position.

9. The toilet according to claim 4, wherein the duct includes a vertical leg extending substantially vertically from the second leg and disposed substantially adjacent the flush reservoir (2).

* * * * *